US006794591B1

(12) United States Patent
Wong

(10) Patent No.: US 6,794,591 B1
(45) Date of Patent: Sep. 21, 2004

(54) FLUID-BASED SWITCHES

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/414,063

(22) Filed: Apr. 14, 2003

(51) Int. Cl.[7] ..... H01H 29/00
(52) U.S. Cl. ..... 200/182
(58) Field of Search ..... 200/182, 187–189, 200/209–219, 233–236; 310/328, 331, 348, 363; 335/4, 47, 78; 385/19

(56) References Cited

U.S. PATENT DOCUMENTS

| | | | | |
|---|---|---|---|---|
| 2,312,672 A | | 3/1943 | Pollard, Jr. | |
| 2,564,081 A | | 8/1951 | Schilling | |
| 3,430,020 A | | 2/1969 | Von Tomkewitsch et al. | |
| 3,529,268 A | | 9/1970 | Rauterberg | |
| 3,600,537 A | | 8/1971 | Twyford | |
| 3,639,165 A | | 2/1972 | Rairden, III | |
| 3,657,647 A | | 4/1972 | Beusman et al. | |
| 3,955,059 A | * | 5/1976 | Graf | 200/181 |
| 4,103,135 A | | 7/1978 | Gomez et al. | |
| 4,158,118 A | * | 6/1979 | Graf | 137/251.1 |
| 4,200,779 A | | 4/1980 | Zakurdaev et al. | |
| 4,238,748 A | | 12/1980 | Goullin et al. | |
| 4,245,886 A | | 1/1981 | Kolodzey et al. | |
| 4,336,570 A | | 6/1982 | Brower | |
| 4,419,650 A | | 12/1983 | John | |
| 4,434,337 A | | 2/1984 | Becker | |
| 4,475,033 A | | 10/1984 | Willemsen et al. | |
| 4,505,539 A | | 3/1985 | Auracher et al. | |
| 4,582,391 A | | 4/1986 | Legrand | |
| 4,628,161 A | | 12/1986 | Thackrey | |
| 4,652,710 A | | 3/1987 | Karnowsky et al. | |
| 4,657,339 A | | 4/1987 | Fick | |
| 4,742,263 A | | 5/1988 | Harnden, Jr. et al. | |
| 4,786,130 A | | 11/1988 | Georgiou et al. | |
| 4,797,519 A | | 1/1989 | Elenbaas | |
| 4,804,932 A | | 2/1989 | Akanuma et al. | |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 36-18575 | 10/1961 |
| JP | 47-21645 | 10/1972 |
| JP | 62-276838 | 12/1987 |
| JP | 63-294317 | 12/1988 |
| JP | 8-125487 | 5/1996 |
| JP | 9-161640 | 6/1997 |
| WO | WO99-46624 | 9/1999 |

OTHER PUBLICATIONS

Marvin Glenn Wong, U.S. patent application Ser. No. 10/137,691 (pending), "A Piezoelectrically Actuated Liquid Metal Switch", May 2, 2002.

(List continued on next page.)

*Primary Examiner*—Michael A. Friedhofer

(57) ABSTRACT

Fluid-based switches are disclosed. In one embodiment, the switch comprises first and second mated substrates defining therebetween at least portions of a number of cavities, the first substrate defining a plurality of indentations defined within a first one of the cavities, a plurality of electrical contacts, each electrical contact deposited within one of the indentations, a switching fluid, held within the first cavity, that serves to open and close at least a pair of the plurality of electrical contacts in response to forces that are applied to the switching fluid, and an actuating fluid, held within one or more of the cavities, that applies the forces to the switching fluid.

24 Claims, 3 Drawing Sheets

U.S. PATENT DOCUMENTS 4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 * 11/2001 Kondoh et al. ..... 200/182
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
6,647,165 B2 * 11/2003 Hu et al. ..... 385/16
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

OTHER PUBLICATIONS

J. Simon, et al., "A Liquid–Filled Microrelay with a Moving Mercury Microdrop", Journal of Microelectromechanical Systems, vol. 6, No. 3, Sep. 1997, pp. 208–216.

TDB–ACC–No.: NB8406827, "Integral Power Resistors For Aluminum Substrate", IBM Technical Disclosure Bulletin, Jun. 1984, US, Vol 27, Issue No. 1B, p. 827.

Bhedwar, Homi C., et al., "Ceramic Multilayer Package Fabrication", Electronic Materials Handbook, Nov. 1989, pp 460–469, vol. 1 Packaging, Section 4: Packages.

Kim, Joonwon, et al., "A Micromechanical Switch With Electrostatically Driven Liquid–Metal Droplet", Sensors and Actuators, A: Physical v 9798, Apr. 1, 2002, 4 pages.

* cited by examiner

FLUID-BASED SWITCHES

BACKGROUND OF THE INVENTION

Liquid metal micro switches (LIMMS) have been made that use a liquid metal, such as mercury, as the switching fluid. The liquid metal may make and break electrical contacts. To change the state of the switch, a force is applied to the switching fluid, which causes it to change form and move. If the adhesion between the electrical contacts and the substrate is poor, the moving switching fluid can sometimes lift the edges of the contacts and cause them to delaminate from the underlying substrate, damaging the switch.

SUMMARY OF THE INVENTION

Fluid-based switches are disclosed. In one embodiment, the switch comprises a first substrate and a second substrate mated together. Defined between the substrates are a number of cavites. Additionally, the first substrate defines a plurality of indentations within a first one of the cavities. A plurality of electrical contacts are each deposited within one of the indentations. Held within the first cavity is a switching fluid that serves to open and close at least a pair of the plurality of electrical contacts in response to forces that are applied to the switching fluid. The switch also includes an actuating fluid, held within one or more of the cavities, that applies the forces to the switching fluid.

In another embodiment, the switch comprises first and second substrates mated together so that a number of cavities are defined between the substrates. The first substrate additionally defines a plurality of indentations within a first one of the cavities. A plurality of wettable pads are each deposited within one of the indentations. Held within the first cavity is a switching fluid that is wettable to the pads. The switching fluid serves to open and block light paths through the first cavity in response to forces that are applied to the switching fluid. An actuating fluid, held within one or more of the cavities, applies the forces to the switching fluid.

BRIEF DESCRIPTION OF THE DRAWINGS

Illustrative embodiments of the invention are illustrated in the drawings in which.

DETAILED DESCRIPTION

Figure 1:
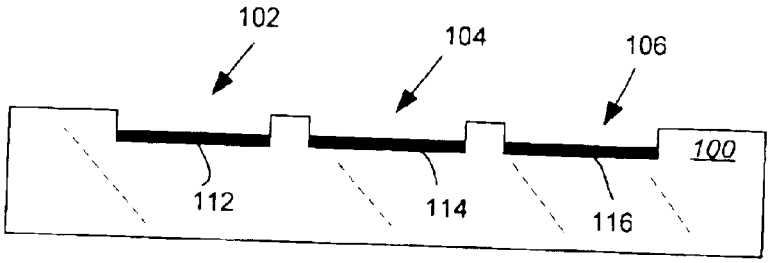
FIG. 1 illustrates an elevation of a first exemplary embodiment of a substrate having indentations that may be used in a fluid-based switch.

FIG. 1 illustrates a substrate 100 that may be used in a fluid-based switch such as a LIMMS. By way of example, substrate 100 may be ceramic or glass. Substrate 100 may define a plurality of indentations 102, 104, 106. The indentations may be formed by sandblasting, laser cutting, photo imaging, chemical etching, or another suitable process. A plurality of wettable pads, possibly serving as an electrical contacts, 112–116 are each deposited within one of the indentations 102–106.

The indentations 102–106 recede the wettable pads 112–116 from the surface of the substrate 100. As will be described in further detail below, the substrate may be used in a fluid-based switch that uses a switching fluid to change the state of the switch. Creating indentations on the substrate 100 that recede the wettable pads 112–116 from the surface of the substrate may help prevent the switching fluid from lifting the edge of the wettable pads during a switch state change.

Figure 2:
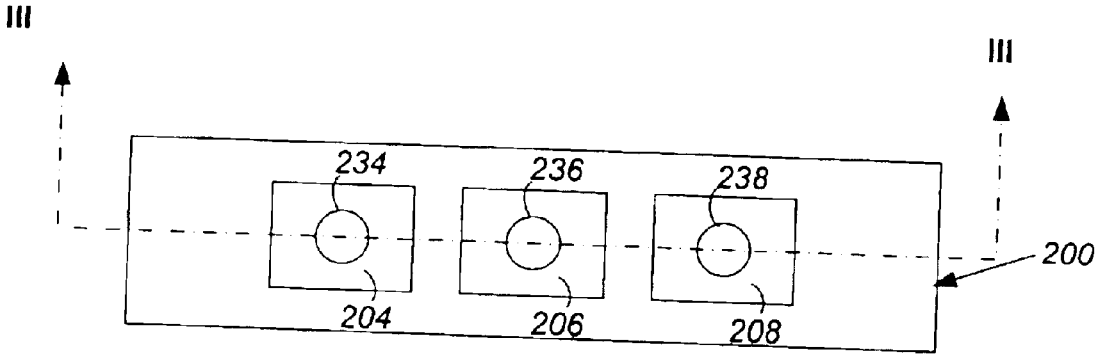
FIG. 2 an illustrates a plan view of a second exemplary embodiment of a substrate having indentations that may be used in a fluid-based switch.
Figure 3:
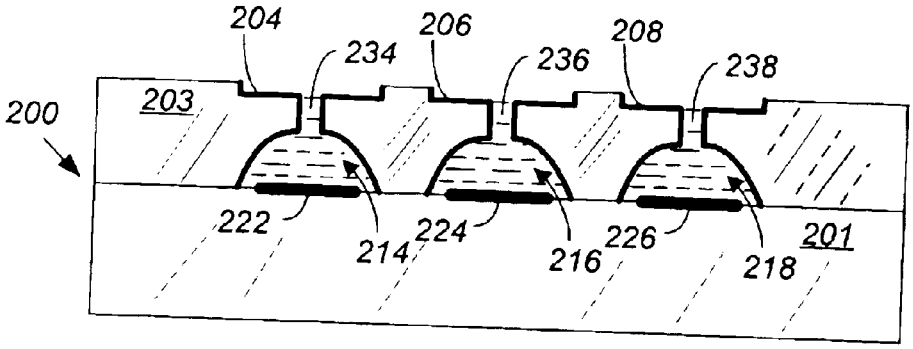
FIG. 3 illustrates an elevation of the substrate of FIG. 2.

FIGS. 2 and 3 illustrate a second exemplary embodiment of a substrate 200 that may be used in a fluid-based switch. A plurality of electrical contacts 222, 224, 226 are deposited on a first layer 201 of the substrate. A second layer 203 is then mated to the first layer 201. By way of example, the second layer may be formed from (or comprise) glass, and the first layer may be formed from (or comprise) a ceramic material. Other suitable materials are also contemplated.

The second layer defines a plurality of ducts 214, 216, 218 that lead from the electrical contacts 222, 224, 226 to a surface of the second layer 203 opposite the electrodes 222, 224, 226. The ducts comprise a bell shape, with the openings of the ducts at the electrodes being wider than the openings of the ducts at the opposite surface of the second layer. The bell shape may have a variety of profiles and may be formed, for example, by masking the second layer and then sandblasting the bell shape(s) into the second layer. Indentations 204, 206, 208 defined by the second layer may be used to recede the openings of the ducts from the surface of the second layer. The indentations have a diameter larger than that of the ducts at the surface of the second layer.

Liquid electrodes (e.g., mercury electrodes) 234, 236, 238 fill at least a portion of each of the ducts. The walls of the ducts may be lined with a wettable material to help the liquid electrodes 234, 236, 238 wet to the ducts. The indentations may also be lined with a wettable material so that a switching fluid used in a fluid-based switch may wet to the indentations. The shape of the ducts 214, 216, 218 may cause the liquid electrodes 234, 236, 238 deposited within each of the ducts to remain within their respective ducts as a switching fluid makes and breaks connections between the electrical contacts 222, 224, 226. The indentations 204, 206, 208 provide a greater contact area for the liquid electrodes 234, 236, 238, and the recessed edges of the indentations may help prevent the wettable linings from lifting their edges and moving out of the indentations.

Figure 4:
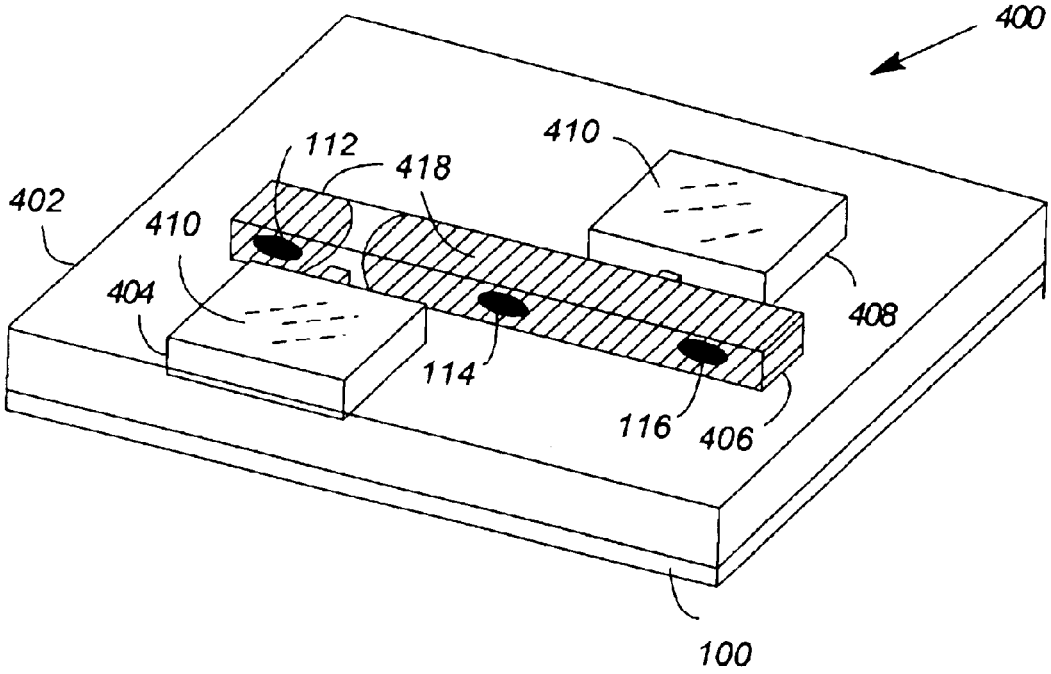
FIG. 4 illustrates a perspective view of a first exemplary embodiment of a switch that may use a substrate having indentations.

FIG. 4 illustrates a first exemplary embodiment of a switch including substrate 100. The switch 400 comprises a first substrate 100 and a second substrate 402 mated together. The substrates 100 and 402 define between them a number of cavities 404, 406, and 408. Exposed within one or more of the cavities are a plurality of electrical contacts 112, 114, 116. Each electrical contact 112–116 is deposited within one of the indentations of substrate 100. A switching fluid 418 (e.g., a conductive liquid metal such as mercury) held within one or more of the cavities serves to open and close at least a pair of the plurality of electrical contacts 112–116 in response to forces that are applied to the switching fluid 418. An actuating fluid 410 (e.g., an inert gas or liquid) held within one or more of the cavities serves to apply the forces to the switching fluid 418.

In one embodiment of the switch 400, the forces applied to the switching fluid 418 result from pressure changes in the actuating fluid 410. The pressure changes in the actuating fluid 410 impart pressure changes to the switching fluid 418, and thereby cause the switching fluid 418 to change form, move, part, etc. In FIG. 4, the pressure of the actuating fluid 410 held in cavity 404 applies a force to part the switching fluid 418 as illustrated. In this state, the rightmost pair of electrical contacts 114, 116 of the switch 400 are coupled to one another. If the pressure of the actuating fluid 410 held in cavity 406 is relieved, and the pressure of the actuating fluid 410 held in cavity 408 is increased, the switching fluid 418 can be forced to part and merge so that electrical contacts 114 and 116 are decoupled and electrical contacts 112 and 114 are coupled.

The indentations 102–106 recede the electrical contacts 112–116 from the surface of the substrate 100. This may help prevent the switching fluid from lifting the edge of the electrical contacts during a switch state change.

By way of example, pressure changes in the actuating fluid 410 may be achieved by means of heating the actuating fluid 410, or by means of piezoelectric pumping. The former is described in U.S. Pat. No. 6,323,444 of Kondoh et al. entitled "Electrical Contact Breaker Switch, Integrated Electrical Contact Breaker Switch, and Electrical Contact Switching Method", which is hereby incorporated by reference for all that it discloses. The latter is described in U.S. patent application Ser. No. 10/137,691 of Marvin Glenn Wong filed May 2, 2002 and entitled "A Piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. Additional details concerning the construction and operation of a switch such as that which is illustrated in FIG. 4 may be found in the afore-mentioned patent of Kondoh.

A second exemplary embodiment of a switch will now be described with reference to FIG. 5. The switch 500 comprises a first substrate 100 and a second substrate 502 mated together. The substrates 100 and 502 define between them a number of cavities 506, 508, 510. Exposed within one or more of the cavities are a plurality of wettable pads 112–116. A switching fluid 518 (e.g., a liquid metal such as mercury) is wettable to the pads 112–116 and is held within one or more of the cavities. The switching fluid 518 serves to open and block light paths 522/524, 526/528 through one or more of the cavities, in response to forces that are applied to the switching fluid 518. By way of example, the light paths may be defined by waveguides 522–528 that are aligned with translucent windows in the cavity 508 holding the switching fluid. Blocking of the light paths 522/524, 526/528 may be achieved by virtue of the switching fluid 518 being opaque. Indentations 102–106 recede the wettable pads 112–116 from the surface of the substrate 100 which may help prevent the switching fluid from lifting the edge of the pad during a switch state change. An actuating fluid 520 (e.g., an inert gas or liquid) held within one or more of the cavities serves to apply the forces to the switching fluid 518.

Figure 5:
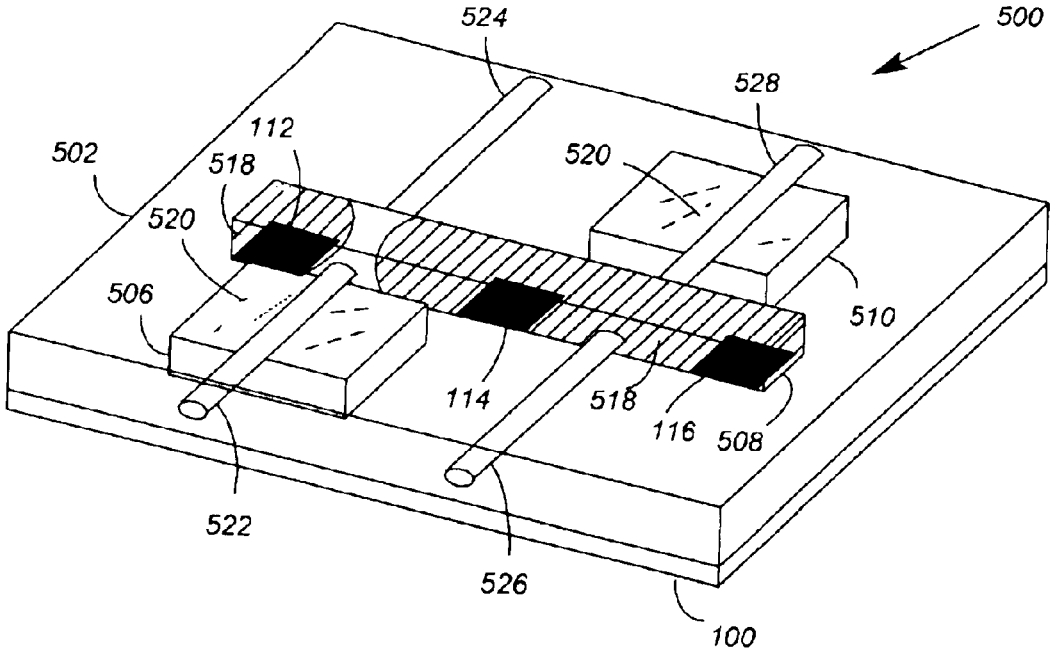
FIG. 5 illustrates a perspective view of a second exemplary embodiment of a switch that may use a substrate having indentations.

Additional details concerning the construction and operation of a switch such as that which is illustrated in FIG. 5 may be found in the aforementioned patent of Kondoh et al., and patent application of Marvin Wong.

Figure 6:
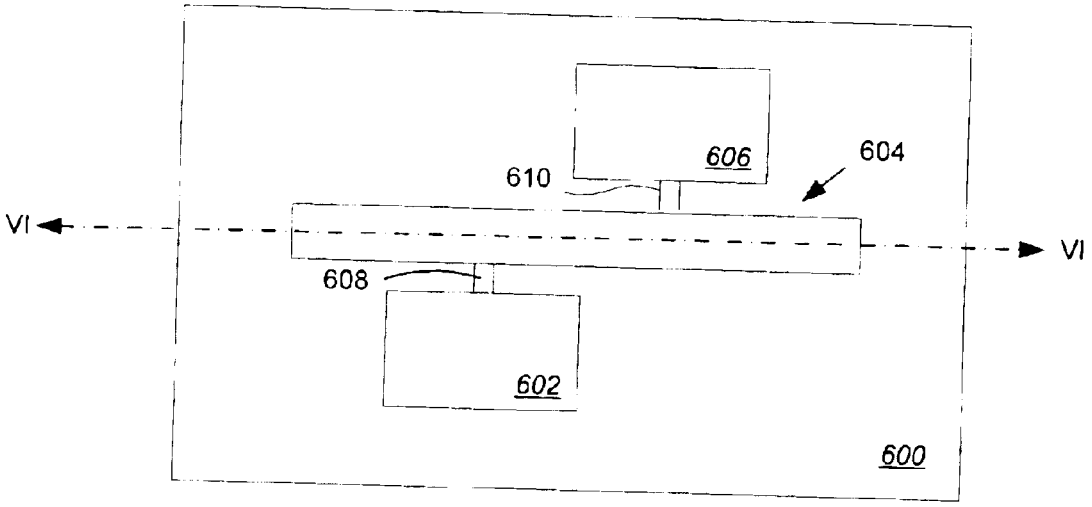
FIG. 6. illustrates a plan view of a third exemplary embodiment of a switch having indentations.
Figure 7:
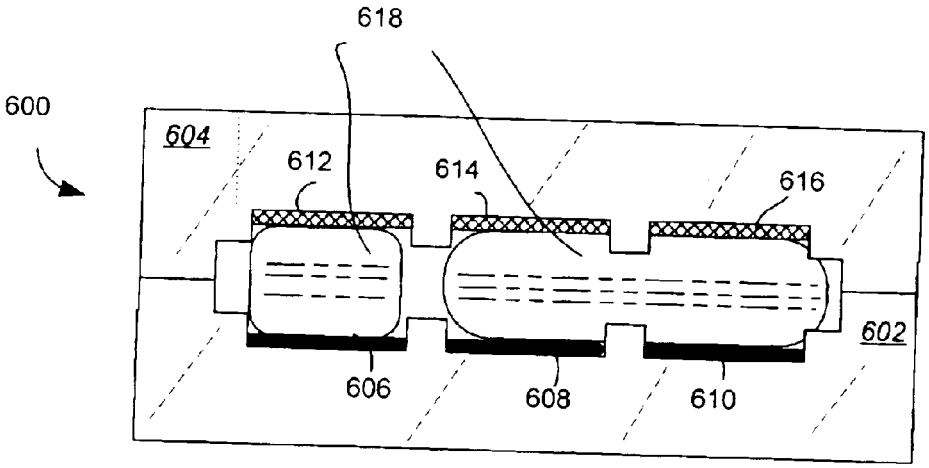
FIG. 7 illustrates an elevation of the switch of FIG. 7.

FIGS. 6 and 7 illustrate a third exemplary embodiment of a fluid-based switch. The switch 600 includes a switching fluid cavity 604, a pair of actuating fluid cavities 602, 606, and a pair of cavities 608, 610 that connect corresponding ones of the actuating fluid cavites 602, 606 to the switching fluid cavity 604. It is envisioned that more or fewer cavites may be formed in the substrate, depending on the configuration of the switch. For example, the pair of actuating fluid cavities 602, 606 and pair of connecting cavities 608, 610 may be replaced by a single actuating fluid cavity and single connecting cavity.

Portions on one of the substrates 602, 604 may be metallized for the purpose of creating "seal belts" 612, 614, 616. The creation of seal belts 612–616 within a cavity holding switching fluid 618 provides additional surface areas to which the switching fluid 618 may wet. This not only helps in latching the various states that a switching fluid can assume, but also helps to create a sealed chamber from which the switching fluid cannot escape, and within which the switching fluid may be more easily pumped (i.e., during switch state changes).

The seal belts 612–616 may be each deposited in an indentation on one of the substrates 602, 604. The indentations recede the seal-belts from the surface of the substrate. This may help prevent the switching fluid 618 from lifting the edge of the seal belts during a change of state of the switch.

The switch additionally includes wettable pads (possibly serving as electrical contacts) 606, 608, 610. The wettable pads are also deposited in indentations on one of the substrates 602. It should be appreciated that in alternate embodiments, the wettable pads may be deposited on a flat surface of the substrate 602 and the substrate may not include the indentations for the wettable pads.

While illustrative and presently preferred embodiments of the invention have been described in detail herein, it is to be understood that the inventive concepts may be otherwise variously embodied and employed. The appended claims are intended to be construed to include such variations, except as limited by the prior art.

What is claimed is:

1. A switch comprising:

first and second mated substrates defining therebetween at least portions of a number of cavities, the first substrate defining a plurality of indentations defined within a first one of the cavities;

a plurality of electrical contacts, each electrical contact deposited within one of the indentations;

a switching fluid, held within the first cavity, that serves to open and close at least a pair of the plurality of electrical contacts in response to forces that are applied to the switching fluid; and an actuating fluid, held within one or more of the cavities, that applies the forces to the switching fluid.

2. The switch of claim 1, further comprising a plurality of seal belts deposited on the second substrate at a location within the first cavity.

3. The switch of claim 2, wherein the second substrate defines a plurality of indentations and the seal belts are deposited within the indentations.

4. The switch of claim 1, wherein the first substrate comprises glass.

5. The switch of claim 1, wherein the first substrate comprises ceramic.

6. The switch of claim 1, wherein the indentations are sandblasted in the first substrate.

7. The switch of claim 1, wherein the indentations are laser cut in the first substrate.

8. The switch of claim 1, wherein the indentations are chemically etched in the first substrate.

9. The switch of claim 1, wherein the first substrate includes a first layer and a second layer, the first layer having the plurality of electrical contacts deposited thereon, and the second layer defining a number of ducts, each duct of the second layer leading from the first cavity to one of the electrical contacts deposited on the first layer, the second layer further defining the plurality of indentations, each indentation defined at an opening of one of the ducts at the surface of the second layer, the indentations having a diameter that is larger than that of the ducts at the surface of the second layer.

10. The switch of claim 9, wherein at least one of the ducts defined by the second layer is defined so that a portion of the switching fluid remains in the duct when the forces are applied to the switching fluid to close pairs of the electrical contacts.

11. A switch comprising:

first and second mated substrates defining therebetween at least portions of a number of cavites, at least one of the substrates defining a plurality of indentations defined within a first one of the cavities;

a plurality of wettable pads, each wettable pad deposited within one of the indentations;

a switching fluid, wettable to said pads and held within the first cavity, that serves to open and block light paths through the first cavity in response to forces that are applied to the switching fluid; and an actuating fluid, held within one or more of the cavities, that applies the forces to said switching fluid.

12. The switch of claim 11, further comprising a plurality of seal belts deposited on the second substrate at a location within the first cavity.

13. The switch of claim 11, wherein the second substrate defines a plurality of indentations and the seal belts are deposited within the indentations.

14. The switch of claim 11, wherein the first substrate comprises glass.

15. The switch of claim 11, wherein the first substrate comprises ceramic.

16. The switch of claim 11, wherein the indentations are sandblasted in the first substrate.

17. The switch of claim 11, wherein the indentations are laser cut in the first substrate.

18. The switch of claim 11, wherein the indentations are chemically etched in the first substrate.

19. The switch of claim 11, wherein the first substrate includes a first layer and a second layer, the first layer having the plurality of electrical contacts deposited thereon, and the second layer defining a number of ducts, each duct of the second layer leading from the first cavity to one of the electrical contacts deposited on the first layer, the second layer further defining the plurality of indentations, each indentation defined at an opening of one of the ducts at the surface of the second layer, the indentations having a diameter that is larger than that of the ducts at the surface of the second layer.

20. The switch of claim 19, wherein at least one of the ducts defined by the second layer is defined so that a portion of the switching fluid remains in the duct when the forces are applied to the switching fluid to close pairs of the electrical contacts.

21. A switch, comprising:

first and second mated substrates defining therebetween at least portions of a number of cavities;

a switching fluid, held within one or more of the cavities, that is movable between at least first and second switch states in response to forces that are applied to the switching fluid; and a plurality of seal belts deposited within indentations on one of the substrates at a location within one or more of the cavities holding the switching fluid.

22. The switch of claim 21, wherein the indentations are laser cut in one of the substrates.

23. The switch of claim 21, wherein the indentations are sandblasted in one of the substrates.

24. The switch of claim 21, wherein the indentations are chemically etched in one of the substrates.

* * * * *